United States Patent [19]

Asher et al.

[11] Patent Number: 4,496,328

[45] Date of Patent: Jan. 29, 1985

[54] COMBINED SWIMMING AID AND LIFESAVING DEVICE

[76] Inventors: William P. Asher, Rte. 3, Harness Creek, Annapolis, Md. 21403; Otto J. Munz, deceased, late of Arlington, Va., by Gerta H. Munz, executrix

[21] Appl. No.: 590,863

[22] Filed: Mar. 19, 1984

Related U.S. Application Data

[62] Division of Ser. No. 296,062, Aug. 25, 1981, abandoned.

[51] Int. Cl.[3] ..... B63C 9/12

[52] U.S. Cl. ..... 441/55; 441/108; 441/115

[58] Field of Search ..... 441/80, 88, 90–101, 441/106–121, 55

[56] References Cited

U.S. PATENT DOCUMENTS

| | | | |
|---|---|---|---|
| 724,279 | 3/1903 | Goldstein | 441/101 |
| 998,698 | 5/1911 | Klint | 441/111 |
| 1,315,190 | 9/1919 | Nekarda | 441/90 |
| 1,647,677 | 11/1927 | Weeks | 441/115 |
| 1,947,005 | 2/1934 | Gunther | 441/111 |
| 2,145,289 | 1/1939 | Boudreaux | 441/108 |
| 2,905,954 | 9/1959 | Lanciano | 441/116 |
| 3,179,963 | 4/1965 | Peterson | 441/115 |
| 3,181,184 | 5/1965 | Potts | 441/108 |
| 3,329,982 | 7/1967 | Zannoni | 441/118 |

FOREIGN PATENT DOCUMENTS

| | | | |
|---|---|---|---|
| 488162 | 12/1953 | Italy | 441/88 |
| 531962 | 1/1941 | United Kingdom | 441/93 |

*Primary Examiner*—Sherman D. Basinger
*Assistant Examiner*—Thomas J. Brahan
*Attorney, Agent, or Firm*—Dennis H. Lambert

[57] ABSTRACT

A combined swimming aid and lifesaving device in which a buoyant harness for encircling the swimmer's torso comprises a plurality of releasably interconnected portions for selective use of one or more parts of the harness to obtain desired buoyancy, and a plurality of separate inflatable buoyant devices are releasably attached to the harness at spaced locations thereon to impart greater or lesser buoyancy to the device for providing desired buoyant support to the swimmer to maintain the swimmer in horizontal position in the water. Attaching points are on the harness for securing a lifeline thereto, and the inflatable buoyant devices remain slack when inflated so that they are able to undulate during use to reduce drag through the water.

6 Claims, 9 Drawing Figures

COMBINED SWIMMING AID AND LIFESAVING DEVICE

This application is a division of application Ser. No. 296,062, filed Aug. 25, 1981, now abandoned.

BACKGROUND OF THE INVENTION

This invention relates generally to lifesaving devices and swimming aids, and more particularly, to a combined lifesaving device and swimming aid which has selectively adjustable size and buoyancy to provide desired support to swimmers of different size and skill.

In the prior art, many different types and styles of lifesaving devices and swimming aids are known. Some of these devices are capable of use both as a lifesaving device and as a swimming aid. Moreover, some of these devices have selectively adjustable size and buoyancy. However, these devices either have substantially fixed harness configurations or fixed buoyancy, with rigid buoyant devices and consequent bulkiness and drag, or inflatable buoyant devices which become relatively rigid when inflated and thus impart considerable drag when moved through the water. Other prior art buoyant devices have essentially one large inflatable chamber so that puncture of this chamber results in loss of all buoyancy. Examples of some prior art devices are in the following U.S. Pat. Nos.: 1,448,460, 1,622,914, 2,312,976, 2,851,706, 2,871,491, 3,030,640, 3,276,432, 3,428,980, 3,903,555, 3,947,906, 4,052,762, 4,194,257 and British published patent application No. 2,003,431.

SUMMARY OF THE INVENTION

The present invention has for its principal object the provision of a combined lifesaving device and swimming aid, wherein the apparatus comprises an adjustable, buoyant harness with a plurality of inflatable buoyant devices selectively attached thereto.

Another object of the invention is to provide a combined lifesaving device and swimming aid wherein the apparatus includes streamlined buoyant means which impart very little drag when moved through the water, and wherein the buoyant means do not interfere with normal swimming movements of the swimmer.

A further object is to provide a combined lifesaving device and swimming aid having a harness with inherent buoyancy and selectively removable portions for adjusting the buoyancy, and having further inflatable buoyant means either integral with the harness or permanently or releasably attached thereto.

Yet another object of the invention is to provide a lifesaving device and swimming aid which has a plurality of separate inflatable devices which are streamlined and which remain slack or flexible when inflated so that they undulate or yield as they move through the water, thus reducing cavitation and drag.

DETAILED DESCRIPTION OF THE PREFERRED EMBODIMENTS

Figure 1:
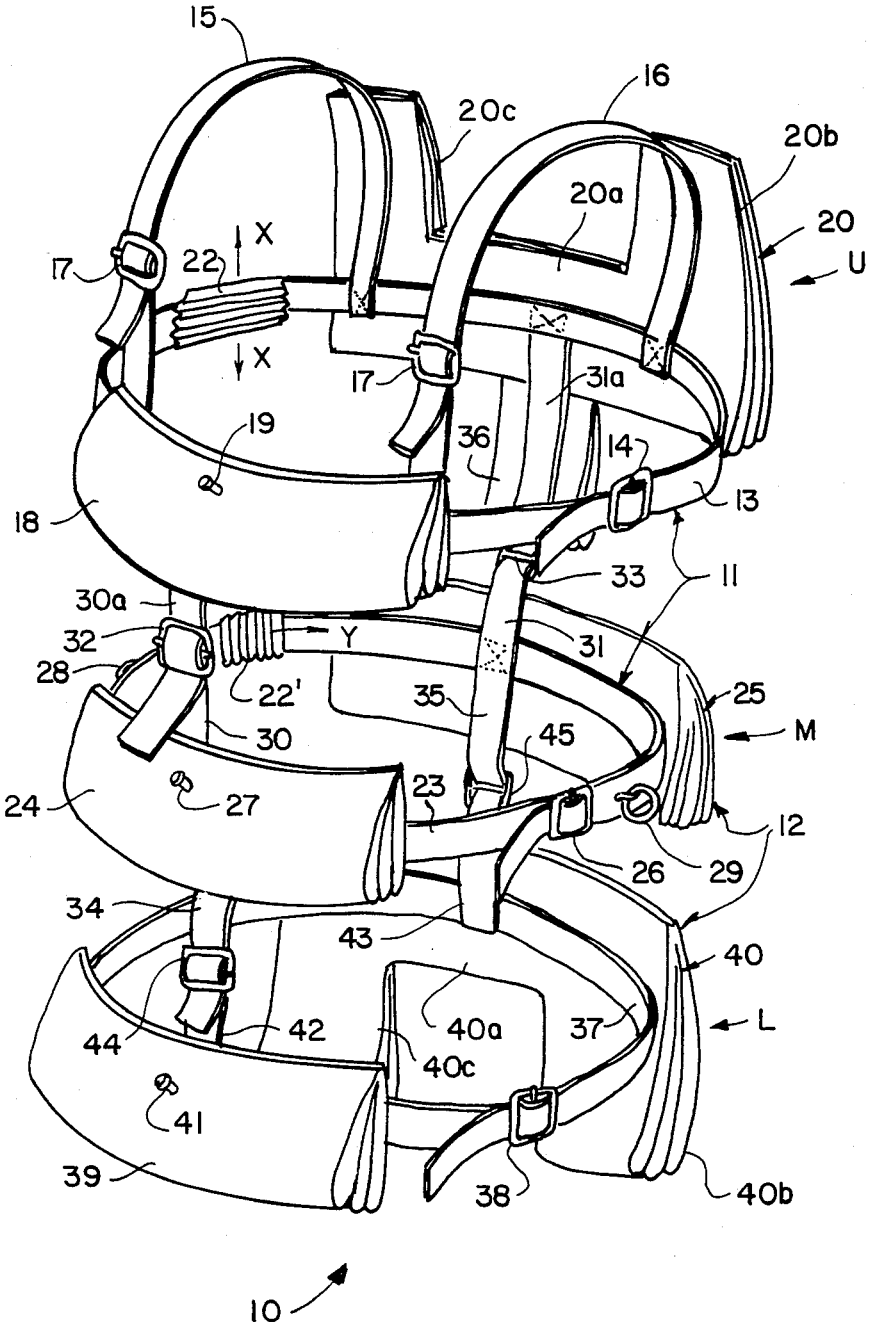
FIG. 1 is a perspective view of a harness with a plurality of inflatable devices attached in accordance with the invention.
Figure 4:
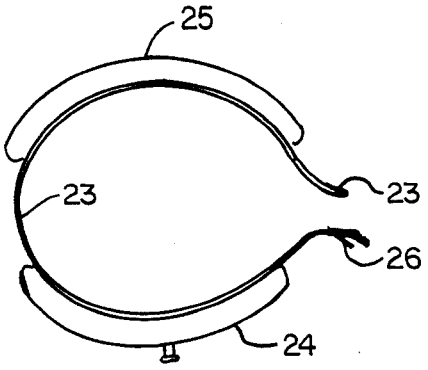
FIG. 4 is a plan view looking down on the bottommost portion of the harness of FIG. 1.
Figure 2:
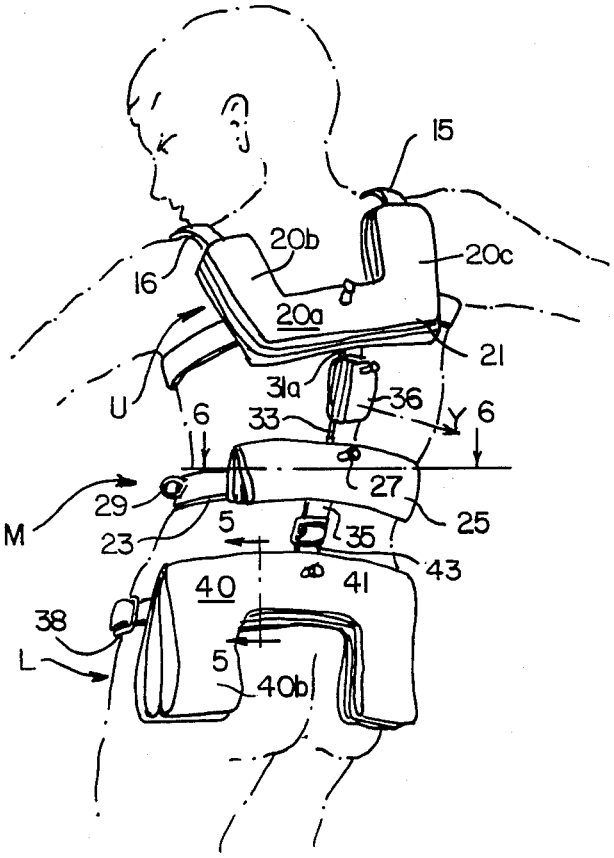
FIG. 2 is a perspective view showing the harness attached to a swimmer, shown from the back.
Figure 3:
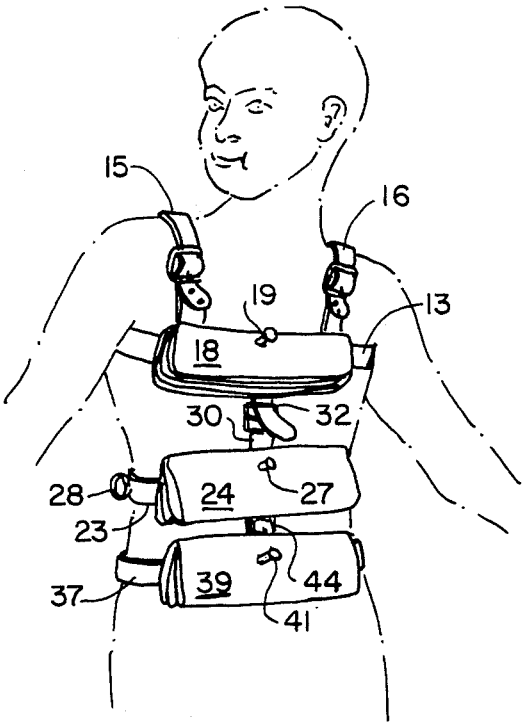
FIG. 3 is a view similar to FIG. 2, showing the device from the front.

In the drawings, wherein like reference numerals indicate like parts throughout the several views, a combined lifesaving device and swimming aid is indicated generally at 10 in FIG. 1, and comprises an apparatus composed of a harness 11 with a plurality of separate inflatable buoyant devices 12 attached thereto.

The harness 11 comprises an upper section U having a torso-encircling belt 13 with a suitable releasable fastener 14 at one side thereof and a pair of shoulder straps 15 and 16, each having a releasable fastener 17. The releasable fasteners also enable the size of the harness to be adjusted to different size swimmers. An inflatable buoyant device 18 is attached to the front of the harness portion U, and has an accordian pleat or fold with a narrow leading edge toward the swimmer's head and a broader edge toward the swimmer's feet. A suitable inflation valve 19 is associated with the inflatable device 18 for admitting and releasing air therefrom. A similar inflatable device 20 is attached to the back of the harness portion U, and includes a part **20*a* extending parallel to the belt 13 and parts 20*b* and 20*c* extending upwardly along the shoulder straps 15 and 16. The device 20 also has an accordian pleat or fold, with a narrow leading edge and a broader trailing edge, and an inflation valve 21. Further, the belt 13 may be provided with an integral inflatable expansion and buoyant device 22 therein as shown, expansible in the lengthwise direction of the swimmer, denoted by axis X. Straps 30*a* and 31*a* extend downwardly from the front and back of the belt 23 and a further buoyant device 36 may be provided on the strap 31*a***, if desired.

The harness 11 also includes a midportion M, comprising a torso-encircling belt 23 with a pair of substantially identical inflatable devices 24 and 25 on the front and back thereof, respectively, and a releasable fastener 26 at one side thereof. The inflatable devices 24 and 25 each have inflation valves 27 associated therewith, and have narrow leading edges and broader trailing edges, with accordian pleats or folds. In addition, a pair of lifeline attaching rings 28 and 29 are provided on opposite sides of the belt 23 for attachment of lifelines or safety ropes or the like. For instance, lines can be attached to the rings to aid in supporting a swimmer and pulling him through the water as he is learning to swim. Straps 30 and 31 at the front and back, respectively, of the belt 23 extend upwardly toward the upper portion U, and are releasably connected to the corresponding straps **30*a* and 31*a* via fasteners 32 and 33. Similar straps 34 and 35 project downwardly from the midportion M. A circumferentially expansible inflatable device 22' is integral with the belt 23** at one side thereof.

A bottom or lower portion L of the harness similarly includes a torso-encircling belt 37 with a fastener 38 at one side thereof and a first buoyant device 39 attached to the front and a second buoyant device 40 attached to the back. The first buoyant device is substantially identical to the buoyant devices 18 and 24, and has an inflation valve 41 and a narrow leading edge and a broader trailing edge, with accordian pleats or folds. However, the second buoyant device 40 is shaped similarly to buoyant device 20 on the upper harness portion U, except that it is reversed. In other words, the buoyant device 40 has a first part 40*a* extending parallel to the belt 37 and second and third parts 40*b* and 40*c* projecting downwardly or rearwardly over the buttocks of the swimmer. Straps 42 and 43 extend upwardly from the front and back, respectively, of the belt 37 and are connected via fasteners 44 and 45 with straps 34 and 35 projecting downwardly from the belt 23 of midportion M.

The harness 11 may be made of any suitable material, although one having elasticity is preferred, and the harness should have substantially neutral buoyancy or equilibrium, predetermined for swimmers having different natural buoyancy. In addition, the harness may be of the slip-on type, eliminating the need for some of the fasteners.

Figure 5:
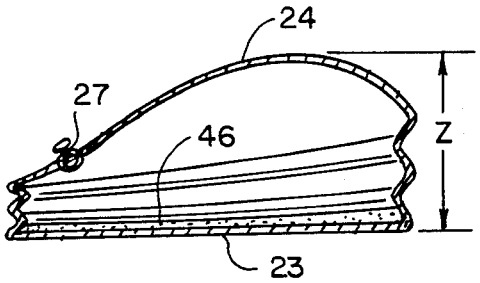
FIG. 5 is a view in section through one of the inflatable devices, taken along line 5—5 in FIG. 2.
Figure 6:
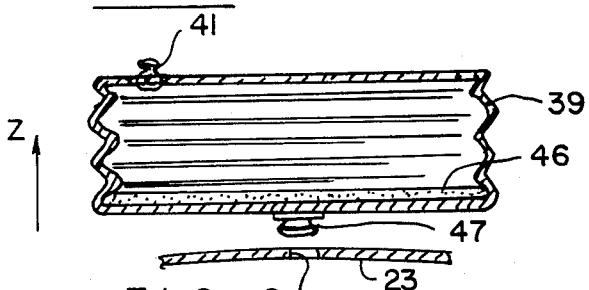
FIG. 6 is a view in section through one of the inflatable devices, taken along line 6—6 in FIG. 2.
Figure 8:
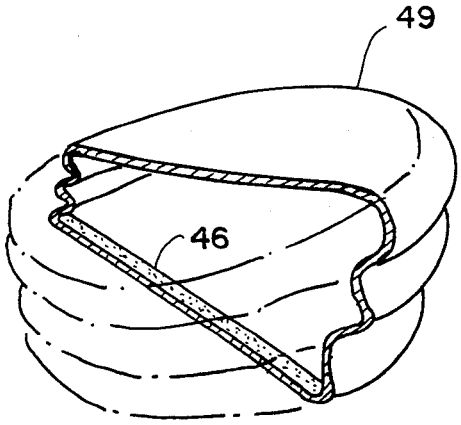
FIG. 8 is a perspective sectional view of a modified buoyant device.

The inflatable devices, which are bellows-like in construction, may include a buoyant base portion 46, as shown in FIGS. 5, 6 and 8, for example, and may be either normally collapsed or normally expanded, whereby in the first instance, it is necessary to blow air into the inflatable devices in order to expand them, and in the latter instance, merely opening the valve will permit the inflatable device to expand, automatically sucking air thereinto. Further, the inflatable devices may be integral or permanently attached to the harness or they may be releasably attached thereto, as shown in FIG. 6 at 47 and 48, wherein suitable fastening means on the base of the inflatable device and on the belt are provided. A particular advantage of the present invention over some conventional lifesaving devices is that when the inflatable devices are deflated, the device is nearly flat, thus requiring less storage space. Additionally, by selectively inflating the different portions of the apparatus, different buoyancies can be imparted to different parts of the apparatus, so that, for example, greater buoyancy can be given to the back of the apparatus than to the front, and greater buoyancy can be given to the bottom or lower part than to the upper part.

A modified buoyant device is illustrated in FIG. 8, wherein the buoyant inflatable device 49 has a substantially round configuration.

Figure 9:
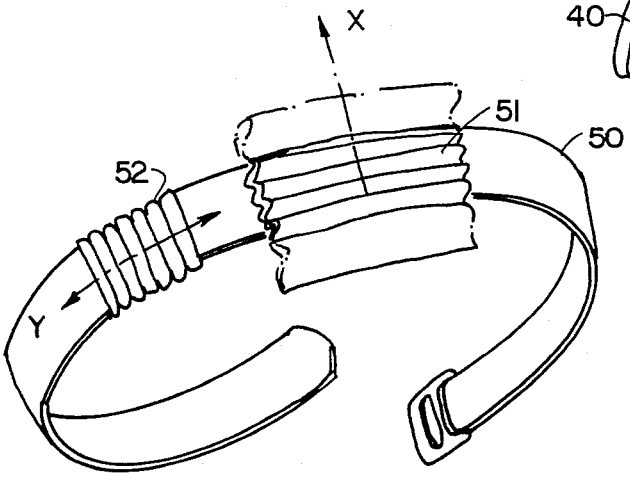
FIG. 9 is a perspective view of a harness portion or belt with integral buoyant devices thereon.

A modified belt or harness part 50 is shown in FIG. 9, and includes two integral inflatable devices 51 and 52, expansible in the axial direction X, as at 22 in FIG. 1, and in the circumferential direction Y, as at 22' in FIG. 1.

Figure 7:
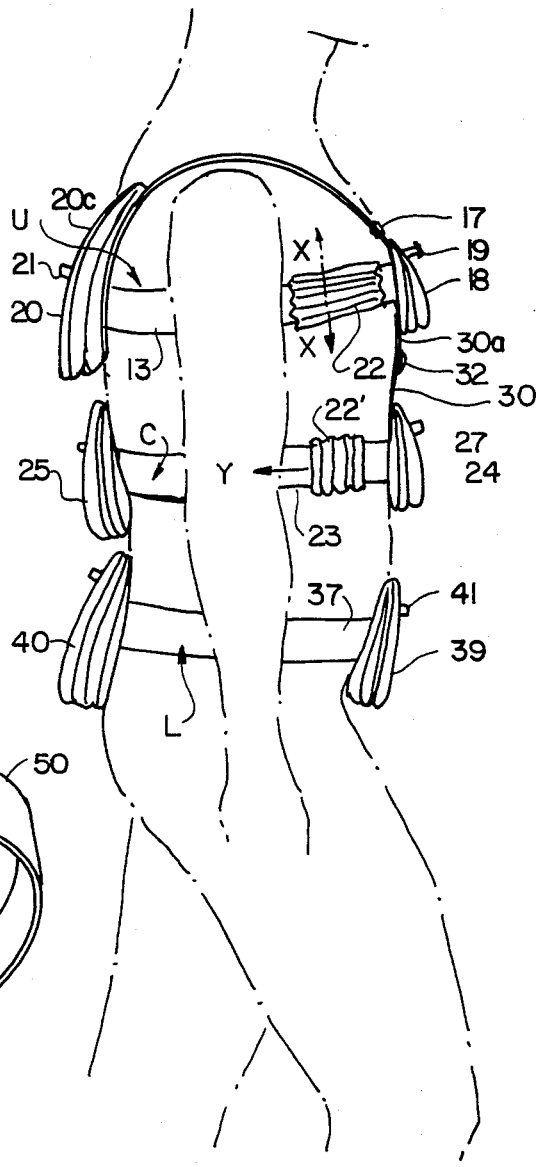
FIG. 7 is a view from the side, showing the device being worn by a swimmer.

Thus, it will be observed that hydrodynamically shaped buoyant devices are provided in the harness of the invention, with the buoyant devices being expansible away from the body of the swimmer in the Z direction, as seen in FIGS. 5, 6 and 7, for example, and having a narrow leading edge and a relatively wider trailing edge. Of course, the drawings are not necessarily to scale, but are intended to most clearly show the nature of the invention.

What I claim as new and desire to secure by Letters Patent of the United States is:

1. A combined swimming aid and lifesaving device, comprising:

a torso-encircling buoyant harness means for releasable attachment to the body of a swimmer to impart substantially neutral equilibrium to the swimmer;

a plurality of separate inflatable buoyant means carried by the harness for selective inflation to impart desired buoyancy to the swimmer; and said buoyant means remaining at least partially slack when inflated and having a narrower leading edge than trailing edge, and having accordian or bellows-like pleats or folds along the leading and trailing edges, whereby the buoyant means presents a streamlined configuration for passage through water and said buoyant means may undulate to reduce drag during use.

2. A combined swimming aid and lifesaving device as in claim 1, wherein:

the harness means comprises a plurality of separable parts for selective application and removal to the body of the swimmer to adjust the buoyancy imparted to the swimmer by the harness means.

3. A combined swimming aid and lifesaving device as in claim 2, wherein:

the separable parts of the harness means include an upper portion for encircling the chest area of the swimmer, a midportion for encircling the waist area of the swimmer, and a lower portion for encircling the pelvic area of the swimmer, the upper portion, midportion and lower portion being interconnected but separable from one another.

4. A combined swimming aid and lifesaving device as in claim 3, wherein:

the inflatable buoyant devices are releasably attached to the harness means.

5. A combined swimming aid and lifesaving device as in claim 3, wherein:

the inflatable buoyant devices are integral with the harness means.

6. A combined swimming aid and lifesaving device as in one of claims 1, wherein:

the inflatable buoyant devices are releasably attached to the harness means.

* * * * *